US006530999B2

(12) United States Patent
Meagher et al.

(10) Patent No.: US 6,530,999 B2
(45) Date of Patent: Mar. 11, 2003

(54) PHOSPHATE CONVERSION COATING

(75) Inventors: Kevin K. Meagher, Northville, MI (US); Brian B. Cuyler, Oxford, MI (US)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/974,433

(22) Filed: Oct. 10, 2001

(65) Prior Publication Data

US 2002/0096229 A1 Jul. 25, 2002

Related U.S. Application Data

(60) Provisional application No. 60/238,972, filed on Oct. 10, 2000.

(51) Int. Cl.[7] ..... C23C 22/07

(52) U.S. Cl. ..... 148/262; 106/14.12; 106/14.44; 148/243; 148/253; 148/261

(58) Field of Search ..... 148/243, 253, 148/261, 262; 106/14.12, 14.44

(56) References Cited

U.S. PATENT DOCUMENTS

| | | | | | |
|---|---|---|---|---|---|
| 4,596,607 | A | | 6/1986 | Huff et al. | 148/6.15 |
| 4,681,641 | A | | 7/1987 | Zurilla et al. | 148/6.15 |
| 4,708,744 | A | * | 11/1987 | Cabado | 106/14.12 |
| 4,713,121 | A | | 12/1987 | Zurilla et al. | 428/472 |
| 4,722,753 | A | | 2/1988 | Zurilla et al. | 428/472.3 |
| 4,950,339 | A | | 8/1990 | Gehmecker et al. | 148/262 |
| 5,082,511 | A | | 1/1992 | Farina et al. | 148/257 |
| 5,236,565 | A | | 8/1993 | Mueller et al. | 204/181.3 |
| 5,238,506 | A | | 8/1993 | Cape et al. | 148/262 |
| 5,378,292 | A | * | 1/1995 | Miller et al. | 106/14.14 |
| 5,449,414 | A | * | 9/1995 | Dolan | 148/247 |
| 5,797,987 | A | * | 8/1998 | Rossio | 106/14.12 |
| 5,868,874 | A | * | 2/1999 | Rossio | 106/14.12 |
| 5,904,786 | A | | 5/1999 | Wendel et al. | 148/262 |
| 6,231,688 | B1 | * | 5/2001 | Ishii et al. | 148/259 |

FOREIGN PATENT DOCUMENTS

| | | |
|---|---|---|
| WO | 01/96627 | * 12/2001 |

* cited by examiner

*Primary Examiner*—Anthony Green
(74) *Attorney, Agent, or Firm*—Stephen D. Harper; Arthur G. Seifert; Mary K. Cameron

(57) ABSTRACT

Phosphate conversion coatings having very fine crystal size are obtained using liquid compositions containing phosphate, zinc cations and relatively low concentrations of Co, Ni and Mn.

19 Claims, No Drawings

PHOSPHATE CONVERSION COATING

CROSS-REFERENCE TO RELATED APPLICATIONS

This application claims priority from U.S. provisional application Serial No. 60/238,972 filed Oct. 10, 2000, the disclosure of which is incorporated herein by reference.

BACKGROUND OF THE INVENTION

This invention relates to the well known general field of phosphate conversion coating of metals and more particularly to phosphate coatings formed from a liquid phosphating composition that contains both zinc and at least one of nickel, cobalt, and manganese as layer forming cations. The coatings formed from such a phosphating composition normally contain both zinc and at least the one(s) of nickel, cobalt, and manganese also present in the phosphating compositions. These coatings may also contain iron, particularly if a ferriferous substrate such as ordinary (non-stainless) steel is being phosphated.

Phosphating compositions with a high total concentration of cations of divalent nickel, divalent cobalt, and/or divalent manganese (these three types of cations being hereinafter usually jointly referred to as "NCM") along with zinc, as taught in U.S. Pat. No. 4,681,641 of Jul. 21, 1987 to Zurilla et al., often provide better corrosion resistance to the metal substrates covered with them than do almost any other kind of commonly used phosphating. The conversion coatings formed by the use of such a phosphating composition, when the composition has a very high nickel concentration, also have smaller crystal sizes than do the coatings produced by almost any other, kind of commonly used phosphating. However, phosphating processes with these compositions are also more prone to sludging and, when the total NCM content is very high, are much more prone to forming hard, heat-insulating scale on metal process equipment surfaces than almost any other type of commonly used phosphating process. Furthermore, phosphating solutions of the high NCM type are also much more expensive than almost any other type of phosphating composition, and this expense has limited their use.

Accordingly, a major object of this invention is to provide less expensive phosphating compositions and/or processes that produce conversion coatings with very fine crystal sizes comparable to those produced by previously known high NCM compositions. Alternative and/or concurrent objects are to reduce, or at least not to exceed, the sludge formation and/or scaling obtained with previously used high NCM phosphating. Further more detailed alternative and/or concurrent objects will be apparent from the description below.

Except in the claims and the operating examples, or where otherwise expressly indicated, all numerical quantities in this description indicating amounts of material or conditions of reaction and/or use are to be understood as modified by the word "about" in describing the broadest scope of the invention. Practice within the numerical limits stated is generally preferred. Also, throughout this description, unless expressly stated to the contrary: percent, "parts of", and ratio values are by weight; the term "polymer" includes "oligomer", "copolymer", "terpolymer", and the like; the description of a group or class of materials as suitable or preferred for a given purpose in connection with the invention implies that mixtures of any two or more of the members of the group or class are equally suitable or preferred; description of constituents in chemical terms refers to the constituents at the time of addition to any combination specified in the description or of generation in situ by chemical reactions specified in the description, and does not necessarily preclude other chemical interactions among the constituents of a mixture once mixed; specification of materials in ionic form additionally implies the presence of sufficient counterions to produce electrical neutrality for the composition as a whole (any counterions thus implicitly specified should preferably be selected from among other constituents explicitly specified in ionic form, to the extent possible; otherwise such counterions may be freely selected, except for avoiding counterions that act adversely to the objects of the invention); the term "paint" and all of its grammatical variations are intended to include any similar more specialized terms, such as "lacquer", "varnish", "electrophoretic paint", "top coat", "color coat", "radiation curable coating", or the like and their grammatical variations; and the term "mole" means "gram mole", and "mole" and its grammatical variations may be applied to elemental, ionic, and any other chemical species defined by number and type of atoms present, as well as to compounds with well defined molecules.

SUMMARY OF THE INVENTION

It has surprisingly been found that the presence of small concentrations of cobalt cations together with concentrations of nickel and manganese considerably lower than in an otherwise conventional high NCM zinc phosphating composition makes it possible to obtain conversion coatings with the desirable very fine crystal size previously obtainable only with high NCM phosphating.

Embodiments of the invention include working aqueous liquid compositions suitable for contacting directly with metal surfaces to provide conversion coatings thereon; liquid or solid concentrates that will form such working aqueous liquid compositions upon dilution with water, optionally with addition of other ingredients; processes of using working aqueous liquid compositions according to the invention as defined above to form protective coatings on metal surfaces and, optionally, to further process the metal objects with surfaces so protected; protective solid coatings on metal surfaces formed in such a process; and metal articles bearing such a protective coating.

DETAILED DESCRIPTION OF THE INVENTION AND PREFERRED EMBODIMENTS

A working composition according to the invention preferably comprises, more preferably consists essentially of, or still more preferably consists of, water and the following components:

(A) dissolved phosphate anions;

(B) dissolved cobalt cations;

(C) dissolved zinc cations; and (D) at least one of dissolved nickel cations and dissolved manganese cations. Optionally, one or more of the following components may also be present:

(E) a phosphating accelerator that is not part of any of components (A) through (D) as recited immediately above;

(F) dissolved chelating molecules (for divalent metal cations) that are not part of any of components (A) through (E) as recited immediately above;

(G) an acidity adjustment agent that is not part of any of components (A) through (F) as recited immediately above;

(H) dissolved fluoride ions that are not part of any of components (A) through (E) as recited immediately above;

(J) dissolved iron cations; and (K) sludge conditioner that is not part of any of components (A) through (J) as recited immediately above.

Additional optional components may also be present.

In a composition according to the invention, component (A) preferably, at least for economy, is sourced to a composition according to the invention by at least one of orthophosphoric acid and its salts of any degree of neutralization. Component (A) can also be sourced to a composition according to the invention by pyrophosphate and other more highly condensed phosphates, including metapho sphates, which tend at the preferred concentrations for at least working compositions according to the invention to hydrolyze to orthophosphates. However, inasmuch as the condensed phosphates are usually at least as expensive as orthophosphates, there is little practical incentive to use condensed phosphates, except possibly to prepare extremely highly concentrated liquid compositions according to the invention, in which condensed phosphates may be more soluble.

Whatever its source, the concentration of component (A) in a working composition according to the invention, measured as its stoichiometric equivalent as $H_3PO_4$ with the stoichiometry based on equal numbers of phosphorus atoms, preferably is at least, with increasing preference in the order given, 0.2, 0.4, 0.6, 0.70, or 0.75% and independently preferably is not more than, with increasing preference in the order given, 20, 10, 6.5, 5.0, 4.0, 3.5, 3.0, 2.0, 1.8, 1.6, or 1.4%. If the phosphate concentration is too low, the rate of formation of the desired conversion coating will be slower than is normally desired, while if this concentration is too high, the cost of the composition will be increased without any offsetting benefit, the metal substrate may be excessively etched, and the quality of the phosphate coating formed may be poor.

Component (B) of dissolved cobalt cations is preferably sourced to the composition as at least one nitrate or phosphate salt (which may of course be prepared by dissolving the elemental metal and/or an oxide or carbonate thereof in acid), although any other sufficiently soluble cobalt salt may be used. The entire cobalt cations content of any water-soluble cobalt salt dissolved in a composition according to the invention is presumed to be cobalt cations in solution, irrespective of any coordinate complex formation or other physical or chemical bonding of the cobalt cations with other constituents of the composition according to the invention. Salts containing divalent cobalt are preferred over those containing trivalent cobalt. Independently of their source, the concentration of cobalt cations in a working composition according to the invention preferably is at least, with increasing preference in the order given, 10, 20, 24, 28, 32, 36, 40, 42, 44, 46, 48, or 50 parts of cobalt cations per million parts of total composition (this unit of concentration being freely used hereinafter for any constituent in any composition and being hereinafter usually abbreviated as "ppm") and independently preferably is not more than, with increasing preference in the order given, 400, 200, 180, 160, 150, 140, 130, 120, 110, or 100 ppm. If the concentration of cobalt is too low, a refined crystal structure will not usually be achieved, while if this concentration is too high, the cost of the composition will increase without any corresponding increase in performance, and the crystal structure also is coarser than when cobalt is used at a preferred concentration.

Zinc cations for component (C) are preferably sourced to a composition according to the invention from at least one zinc phosphate salt, at least one zinc nitrate salt, and/or by dissolving at least one of metallic zinc, zinc oxide, and zinc carbonate in a precursor composition that contains at least enough phosphoric and/or nitric acid to convert the zinc content of the oxide to a dissolved zinc salt. However, these preferences are primarily for economy and availability of commercial materials free from amounts of impurities that adversely affect phosphating reactions, so that any other suitable source of dissolved zinc cations could also be used. The entire zinc content of any salt or other compound dissolved or reacted with acid in a composition according to the invention is to be presumed to be present as cations when determining whether the concentration of zinc cations satisfies a concentration preference as noted below.

In any working composition according to the invention, the concentration of zinc cations preferably is at least, with increasing preference in the order given, 0.020, 0.030, 0.040, or 0.050% and independently preferably is not more than, with increasing preference in the order given, 2.0, 1.5, 1.2, 1.0, 0.80, 0.70, 0.60, 0.55, 0.50, 0.45, 0.40, 0.36, or 0.33%. If the zinc concentration is either too low or too high, the corrosion-protective quality of the coating is likely to be inferior, and if this concentration is too low, the rate of coating formation also is likely to be slower than desirable.

Component (D) of manganese and/or nickel cations is preferably sourced to a phosphating composition according to the invention by a nitrate or phosphate salt of these metals, the divalent cations of each metal being preferred. The entire content of the metal in any water soluble salt dissolved, or any elemental metal, metal oxide, or the like reacted with acid to form an aqueous solution in the course of preparing a composition according to the invention, is to be considered as free cations for determining whether the concentration conforms to preferences given below.

The presence of both nickel and manganese cations is preferred over either type of cations alone. When both types are present, independently for each preference stated, in a working composition according to the invention:

the concentration of nickel cations preferably is at least, with increasing preference in the order given, 0.010, 0.030, 0.040, 0.050, or 0.060% and independently preferably is not more than, with increasing preference in the order given, 0.60, 0.50, 0.40, 0.30, 0.25, 0.20, or 0.15%;

the concentration of manganese cations preferably is at least, with increasing preference in the order given, 0.005, 0.010, or 0.020% and independently preferably is not more than, with increasing preference in the order given, 0.60, 0.50, 0.40, 0.30, 0.25, 0.20, or 0.15%; and the ratio of the percent concentration of manganese cations to the percent concentration of nickel cations preferably is at least, with increasing preference in the order given, 0.10:1.00, 0.20:1.00, or 0.30:1.00, and independently preferably is not more than, with increasing preference in the order given, 1.8:1.00, 1.6:1.00, 1.4:1.00, 1.2:1.00, 1.10:1.00, 1.05:1.00, 1.00:1.00, 0.95:1.00, or 0.92:1.00.

If only nickel or only manganese is utilized for component (D), its concentration in a working composition preferably is at least,: with increasing preference in the order given, 0.015, 0.02, 0.05, or 0.08% and independently preferably is not more than, with increasing preference in the order given, 2.0, 1.5, 1.0, 0.8, 0.6, 0.4, or 0.30%.

If the concentration of component (D) is too low, the rate of formation of the coating will usually be slower than is desirable, unless the concentration of zinc is high, and in that instance, or if the concentration of either nickel or manganese is too low, the corrosion-protective value of the coating will be sub-optimal. If the concentration of component (D) as a whole or of either nickel or manganese is too high, the cost will be increased without any offsetting benefit, and the corrosion-protective value of the coating formed also will usually be sub-optimal.

Optional component (E) of conversion coating accelerator preferably is present in a composition according to the invention, because without this component the coating formation rate usually is slower than is desired. The accelerator when present in a working composition according to the invention preferably is selected from the group consisting of: chlorate ions (preferably, 0.3 to 4 parts per thousand parts of total phosphating composition, this unit of concentration being freely used hereinafter for any constituent of the composition and being hereinafter usually abbreviated as "ppt"), nitrite ions (preferably, 0.01 to 0.2 ppt); m-nitrobenzene sulfonate ions (preferably, 0.05 to 2 ppt); m-nitrobenzoate ions (preferably, 0.05 to 2 ppt); p-nitrophenol (preferably, 0.05 to 2 ppt); hydrogen peroxide in free or bound form (preferably, 0.005 to 0.15 ppt); hydroxylamine in free or bound form (preferably, 0.02 to 10 ppt); a reducing sugar (preferably, 0.1 to 10 ppt); nitroguanidine; and nitrate ions. Nitrate ions are preferred within this group. Nitrate ions are preferably sourced to the composition by at least one of nitric acid and its salts. When nitrate ions are present in a working composition according to the invention, their concentration more preferably is at least, with increasing preference in the order given, 0.001, 0.005, 0.010, or 0.020% and independently preferably is not more than, with increasing preference in the order given, 8.0, 6.0, 4.0, 3.0, 2.5, 2.0, or 1.7%. If the concentration of nitrate is too high, the danger of emissions of noxious oxides of nitrogen from the phosphating composition is increased, while if this concentration is too low, the rate of formation of the phosphate coating will usually be slower than desirable, and the corrosion-protective quality of the coating may be poor.

In addition to nitrate, a composition according to the invention preferably contains hydroxylamine as an accelerator, in an amount that preferably is at least, with increasing preference in the order given, 1, 5, or 8 ppm and independently preferably is not more than, with increasing preference in the order given, 300, 200, 150, 125, 100, 90, 80, 70, 65, 60, 55, 50, or 45 ppm. As is usual in phosphating compositions in which hydroxylamine is used, it is preferably supplied to the composition in the form of a salt, complex, or even a hydrolyzable compound such as an oxime, because pure hydroxylamine is chemically unstable. The entire stoichiometric equivalent as pure hydroxylamine of any such "bound" form of hydroxylamine sourced to the composition is to be considered as hydroxylamine in assessing conformance to the concentration preferences stated above. The single most preferred source, primarily for economy and ready commercial availability, is hydroxylamine sulfate.

The presence of optional component (F) of dissolved chelating molecules in a composition according to the invention is preferred when water with any significant hardness is expected to be used in making up a working composition according to the invention. Calcium and/or magnesium cations, usually present in hard water, can precipitate phosphate as sludge and/or become incorporated into the phosphate coating, both possibilities being generally undesirable. These potential difficulties can be prevented by including in the composition chelating molecules that can form strong coordinate bonds to calcium and magnesium cations. The chelating molecules are preferably selected from organic molecules each of which contains at least two moieties selected from the group consisting of carboxyl, other hydroxyl, carboxylate, phosphonate, and amino, these moieties being arranged within the molecules selected so that a five- or six-membered ring, including a chelated metal atom and two nucleophilic atoms in the chelating molecule, can be formed by chelation. For convenience and economy at least, the chelating agent when used preferably is selected from the group consisting of tartaric acid, maelic acid, citric acid, gluconic acid, and salts of all of these acids.

A phosphating composition according to this invention is necessarily acidic. Its acidity is preferably measured for control and optimization by two characteristics familiar in the art as "points" of Free Acid (hereinafter usually abbreviated as "FA") and of Total Acid (hereinafter usually abbreviated as "TA"). Either of these values is measured by titrating a 10.0 milliliter sample of the composition with 0.100 N strong alkali. If FA is to be determined, the titration is to an end point of pH 3.8 as measured by a pH meter or an indicator such as bromcresol green or bromthymol blue, while if TA is to be determined, the titration is to an end point of pH 8.0 as measured by a pH meter or an indicator such as phenolphthalein. In either instance, the value in points is defined as equal to the number of milliliters of the titrant required to reach the end point.

A working phosphating composition according to this invention preferably has an FA value that is at least, with increasing preference in the order given, 0.3, 0.5, 0.8, 1.0, 1.3, 1.6, 1.9, 2.1, or 2.3 points and independently preferably is not more than, with increasing preference in the order given, 10, 8, 6.0, 5.0, 4.5, 4.0, 3.7, 3.5, 3.3, 3.1, 2.9, or 2.7 points. Also and independently, a working phosphating composition according to the invention preferably has a TA value that is at least, with increasing preference in the order given, 13, 16, 19, 21, 23, or 25 points and independently preferably is not more than, with increasing preference in the order given, 50, 40, 36, 34, 32, or 30 points. If either the FA or the TA value is too low, the phosphating coating formation will be lower than is usually desired, while if either value is too high there may be excessive dissolution of the substrate and/or suboptimal crystal morphology in the coating formed. Ordinarily, the FA and TA values can be brought within a preferred range by use of appropriate amounts of acidic sources of phosphate, nitrate, and/or complexed fluoride and basic sources of zinc and/or NCM, but if needed, optional component (G) preferably is used to bring the composition within a preferred range of both TA and FA. Alkali metal hydroxides, carbonates, and/or oxides are preferably used for this purpose if alkalinity is needed, and phosphoric acid and/or nitric acid is preferably used if acidity is needed.

The presence of optional component (H) of dissolved fluoride in a composition according to the invention is preferred when phosphatizing aluminum or an alloy that contains a substantial fraction of aluminum, because without fluoride present the accumulation of aluminum cations in the phosphating composition will quickly reduce the effectiveness of the composition. When fluoride is present in sufficient quantity, aluminum cations form complex anions with the fluoride ions, and a much larger concentration of aluminum in anionic form than in cationic form can be present without harming the effectiveness of the phosphating composition. If substantial amounts of chloride are present in the phosphating composition, as may readily occur when the water supply used is high in chloride and/or when some of the active ingredients contain chloride as an impurity, and a predominantly zinciferous surface is being phosphated, the presence of dissolved fluoride in a composition according to the invention is also preferred, in order to minimize the danger of forming the small surface blemishes known in art as "white specking", "seediness", or the like. In most other instances, however, fluoride is not needed and when not needed is preferably omitted.

When fluoride is present in a phosphating composition according to this invention, it preferably is sourced to the composition in two differing forms: "uncomplexed fluoride" supplied by hydrofluoric acid and/or one of its salts (which may be partially or totally neutralized); and "complexed fluoride" supplied to the composition by at least one of the acids $HBF_4$, $H_2SiF_6$, $H_2TiF_6$, $H_2ZrF_6$, and $H_2HfF_6$, and their salts (which also may be partially or totally neutralized). Among this group, $H_2SiF_6$ and its salts are most preferred, the acid itself being usually preferred for economy and ready commercial availability. Uncomplexed fluoride promotes etching of the substrate being phosphated and therefore can not be present in too large a concentration without damaging the effectiveness of the phosphating process. The presence of complexed fluoride is believed to result in a "free fluoride buffering" effect: As originally uncomplexed fluoride is consumed by complexing aluminum cations introduced into the phosphating composition by its use on an aluminiferous substrate, the originally complexed fluoride partially dissociates to maintain its equilibrium with free fluoride and thereby provides more capacity for complexing additional aluminum ions.

When both uncomplexed and complexed fluorides are present in a working phosphating composition according to the invention, the concentration of complexed fluoride in the phosphating composition preferably is at least, with increasing preference in the order given, 0.25, 0.50, 1.0, or 1.5 ppt and independently preferably is not more than, with increasing preference in the order given, 20, 15, 10.0, 7.0, 5.0, or 4.0 p:pt; independently, the concentration of uncomplexed fluoride in the phosphating composition preferably is at least, with increasing preference in the order given, 0.05, 0.10, 0.15, 0.20, 0.25, or 0.30 and independently preferably is not more than, with increasing preference in the order given, 7.0, 6.0, 5.0, 4.5, 3.5, 2.5, 2.0, 1.5, or 1.0; and, independently, the ratio of uncomplexed fluoride to complexed fluoride preferably is at least, with increasing preference in the order given, 0.02:1.00, 0.04:1.00, 0.06:1.00, 0.08:1.00, 0.10:1.00, 0.12:1.00, or 0.14:1.00 and independently preferably is not more than, with increasing preference in the order given, 2.0:1.00, 1.5:1.00, 1.00:1.00, 0.80:1.00, 0.50:1.00, 0.45:1.00, or 0.40:1.00.

If a phosphating composition according to the invention contains either fluoride only in uncomplexed form or fluoride only in complexed form, the total fluoride content of the composition preferably is at least, with increasing preference in the order given, 0.05 or 0.10 ppt and independently preferably is, with increasing preference in the order given, not more than 20, 15, 10,7, or 5 ppt.

It has surprisingly been found that the presence of iron cations can reduce the formation of scale and/or sludge, even when a phosphating composition is maintained at a high temperature. Therefore, if either scaling or sludging is a problem in a process according to this invention when no iron cations are present, inclusion of optional component (J) of iron cations to reduce this problem is generally preferred. When used, iron cations are preferably sourced to a phosphating composition according to the invention by a source of iron(III) ions, most preferably ferric nitrate, although other water-soluble sources of ferric ions may be used. The solubilities of ferric phosphate and of ferric hydroxide are rather low in the presence of preferred amounts of other constituents of a preferred phosphating composition according to this invention, and when iron cations are included in a working phosphating composition according to the invention the concentration of the iron cations preferably is at least, with increasing preference in the order given, 40, 60, 80, or 100% of its saturation level. Saturation is believed to correspond to about 10 ppm. In order to assure maintenance of the most preferred fully saturated concentration of dissolved iron cations, it is preferred to provide to a phosphating composition according to the invention an amount of total ferric salt that contains at least, with increasing preference in the order given, 20, 30, 40, 50, or 60 ppm of iron cations, most of which remains undissolved unless and until some of the dissolved ferric ions are removed from the composition by drag-out, precipitation as sludge, or the like.

Optional component (K) of sludge conditioner is not always needed in a composition according to the invention and therefore is preferably omitted in such instances. However, in many instances, at least one such conditioner may be advantageously used, in order to make separation and collection of any sludge that forms easier. In any such instances, suitable material for these purposes can be readily selected by those skilled in the art. Examples include natural gums such as xanthan gum, urea, and surfactants such as sodium 2-ethylhexyl sulfonate.

For various reasons, almost always including at least a cost saving from elimination of an unnecessary ingredient, it is preferred that a composition according to this invention should be largely free from various materials often used in prior art compositions. In particular, compositions according to this invention: in most instances preferably do not contain, with increasing preference in the order given, and with independent preference for each component named, more than 5, 4, 3, 2, 1, 0.5, 0.25, 0.12, 0.06, 0.03, 0.015, 0.007, 0.003, 0.001, 0.0005, 0.0002, or 0.0001% of each of (i) dissolved unchelated calcium and magnesium cations, (ii) dissolved copper cations, (iii) dissolved aluminum, and (iv) dissolved chromium in any chemical form.

In addition to and independently of the specific preferred concentrations for various components specified above, certain ratios between some of the components are preferred. More specifically, independently for each:

- the ratio of % of zinc to % of orthophosphoric acid (stoichiometric equivalent) preferably is at least, with increasing preference in the order given, 0.01:1.00, 0.02:1.00, 0.03:1.00, or 0.04:1.00, and independently preferably is not more than, with increasing preference in the order given, 1.0:1.00, 0.8:1.00, 0.6:1.00, 0.50:1.00, 0.40:1.00, or 0.35:1.00;
- the ratio of % cobalt to % total of nickel and manganese preferably is at least, with increasing preference in the order given, 0.004:1.00, 0.008:1.00, 0.012:1.00, 0.015:1.00, 0.018:1.00, or 0.020:1.00 and independently preferably is not more than, with increasing preference in the order given, 0.15:1.00, 0.10:1.00, or 0.09:1.00;
- the ratio of % total of nickel and manganese to % zinc preferably is at least, with increasing preference in the order given, 0.2:1.00, 0.4:1.00, 0.50:1.00, 0.60:1.00, 0.65:1.00, 0.70:1.00, 0.75:1.00, 0.80:1.00, or 0.85:1.00, and independently preferably is not more than, with increasing preference in the order given, 4.0:1.00, 3.0:1.00, 2.5:1.00, or 2.1:1.00;

the ratio of % nitrate anions to % phosphoric acid (stoichiometric equivalent) preferably is at least, with increasing preference in the order given, 0.1:1.00, 0.2:1.00, or 0.3:1.00, and independently preferably is not more than, with increasing preference in the order given, 5.0:1.00, 4.0:1.00, 3.0:1.00, 2.5:1.00, 2.0:1.00, 1.8:1.00, 1.6:1.00, 1.50:1.00, 1.45:1.00, 1.40:1.00, 1.35:1.00, 1.30:1.00, 1.25:1.00, or 1.20:1.00;

the ratio of % cobalt to % zinc preferably is at least, with increasing preference in the order given, 0.001:1.00, 0.005:1.00, 0.010:1.00, 0.015:1.00, or 0.020:1.00, and independently preferably is not more than, with increasing preference in the order given, 0.250:1.00, 0.200:1.00, or 0.150:1.00.

Preferred concentrations have been specified above for working compositions according to the invention, but another embodiment of the invention is a make-up concentrate composition that can be diluted with water only, or with water and an acidifying or alkalinizing agent only, to produce a working composition, and the concentration of ingredients other than water in such a concentrate composition preferably is as high as possible without resulting in instability of the concentrate during storage. A high concentration of active ingredients in a concentrate minimizes the cost of shipping water from a concentrate manufacturer to an end user, who can almost always provide water more cheaply at the point of use. More particularly, in a concentrate composition according to this invention, the concentration of each ingredient other than water preferably is at least, with increasing preference in the order given, 2, 4, 6, 8, 10, 12, 14, 16, or 18 times as great as the preferred minimum amounts specified above for working compositions according to the invention; independently, the concentration of each ingredient other than water preferably is not more than, with increasing preference in the order given, 50, 40, 35, 30, 25, 23, 21, or 19 times as great as the preferred maximum amounts specified above for working compositions according to the invention. (The Free Acid and Total Acid "points" are not ingredients in this sense, because these values depend on interactions among various constituents and do not scale linearly on dilution as do the concentrations of specific ingredients such as zinc ions or nitrate ions.) In addition to the concentrations recited above, a make-up concentrate preferably has the same ratios between various ingredients as are specified for working compositions above.

A phosphating composition according to the invention is preferably maintained while coating a metal substrate in a process according to the invention at a temperature that is at least, with increasing preference in the order given, 25, 35, 45, 50, 53, 56, or 59° C. and independently preferably is not more than, with increasing preference in the order given, 95, 90, 85, 80, 78, 76, 74, or 72° C.

The specific areal density (also often called "add-on weight [or mass]") of a phosphate coating formed according to this invention preferably is at least, with increasing preference in the order given, 0.3, 0.6, 0.8, 1.0, 1.2, 1.4, or 1.6 grams of dried coating per square meter of substrate coated, this unit of coating weight being hereinafter usually abbreviated as "$g/m^2$", and independently preferably is not more than, with increasing preference in the order given, 10, 8, 6, 5.0, 4.5, 4.0, or 3.5 $g/m^2$. The phosphate conversion coating weight may be measured by stripping the conversion coating in a solution of chromic acid in water as generally known in the art.

Before treatment according to the invention, metal substrate surfaces preferably are conventionally cleaned, rinsed, and "conditioned" with a Jernstedt salt or an at least similarly effective treatment, all in a manner well known in the art for any particular type of substrate; and after a treatment according to the invention the composition according to the invention generally should be rinsed off the surface coated before drying.

This invention is particularly advantageously, and therefore preferably, used on zinciferous metal substrates, such as galvanized steel of all kinds and zinc-magnesium and zinc-aluminum alloys, or more generally any metal alloy surface that is at least 55% zinc. Further and independently, this invention is particularly advantageously, and therefore preferably, used when it is desired to complete formation of a phosphate conversion coating very rapidly, specifically in not more than, with increasing preference in the order given, 45, 30, 25, 20, 15, 10, or 5 seconds of contact time between the substrate metal being treated and a liquid phosphating composition according to the invention. Such short contact times are particularly likely to be economically required in the processing of continuous coil stock.

The practice of this invention may be further appreciated by consideration of the following, non-limiting, working examples, and the benefits of the invention may be further appreciated by reference to the comparison examples.

EXAMPLE AND COMPARISON EXAMPLE 1

In these tests, example and comparison example concentrates were first prepared, using the ingredients shown in Table 1 below.

TABLE 1

| Ingredient | Concentration, as % of the Total Composition, for the Ingredient Shown at Left, in Concentrate for: Example 1 | Comparison Example 1 |
|---|---|---|
| $H_3PO_4$, 75 % solution in water | 24 | 24 |
| $HNO_3$, 100% | 13.0 | 13.0 |
| $(HONH_2)_2.H_2SO_4$ | 0.20 | 0.20 |
| MnO | 2.3 | 2.3 |
| ZnO | 5.0 | 5.0 |
| $NaNO_3$ | 10.0 | 10.0 |
| Solution in water of $Ni(NO_3)_2$, the solution containing 14.0% of Ni | 14.3 | 14.3 |
| Tartaric acid | 1.10 | 1.10 |
| Solution in water of $Co(NO_3)_2$, the solution containing 13.2% of Co | 0.74 | none |
| Additional water | Balance | Balance |

Working compositions were made by diluting each concentrate shown in Table 1 to a concentration of 5.3% by weight; during the dilution process, sufficient sodium carbonate was added to lower the Free Acid and Total Acid values to 2.4 points and 27 points, respectively. Conventional rectangular test panels of hot-dip galvanized steel were used, and the substrates were subjected to the following sequence of process operations, in all of which contact between the substrate and the treatment liquid was by immersion unless otherwise stated and in which all materials identified by registered trademark names are commercially available from the Henkel Surface Technologies Div. of Henkel Corp., Madison Heights, Mich.:

1. Clean for 10 seconds by a spray process using PARCO Cleaner 1200.
2. Rinse with tap water for 10 seconds.
3. Condition for 1 second by a spray process using PARCOLENE AT.

4. Form phosphate coating by immersion (in a reaction cell with counter current flow) for 10 seconds in one of the working phosphating compositions described last above, the phosphating composition being maintained at 71° C. during its contact with the substrate.
5. Post treat by a process using PARCOLENE 62 for 1 to 2 seconds by a "flood-and-squeegee" contact method.
6. Allow to dry.
7. Coat with a layer about 62 micrometers thick of Akzo Nobel 9X444 primer, then bake for 47 seconds at 371° C. to reach a peak metal temperature of 232 to 240° C.
8. Coat with Akzo Nobel top coat KW3R25794, then bake for about 57 seconds to reach a peak metal temperature of 232 to 249° C.

After the thus prepared panels had cooled to normal room temperature, a line was scribed on each panel through the protective coating to the metal below, and the panels were subjected to conventional continuous salt spray accelerated corrosion testing. After 1008 hours of exposure, the extent in millimeters of the creep of the protective coating away from the scribed line and from the edges of the panels was measured. The results are shown in Table 2 below and indicate superior corrosion resistance for the Example according to the invention.

TABLE 2

| | Creep Values from: | | | |
|---|---|---|---|---|
| | Scribe | | Edge | |
| Identification | Maximum | Average | Maximum | Average |
| Example 1 | 6.2 | 2.4 | 7.4 | 3.1 |
| Comparison Example 1 | 6.7 | 3.4 | 10.5 | 4.4 |

Also, some of the panels were examined by scanning electron microscopy at 1000 times magnification after completion of Operations 1 through 6 as listed above only. The average crystal size thus observed was smaller on the panel treated with Example 1 than on the panel treated with Comparison Example 1.

EXAMPLE AND COMPARISON EXAMPLE 2

In these tests, example and comparison example concentrates were first prepared, using the ingredients shown in Table 3 below

TABLE 3

| | Concentration, as % of the Total Composition, for the Ingredient Shown at Left, in Concentrate for: | |
|---|---|---|
| Ingredient | Example 2 | Comparison Example 2 |
| $H_3PO_4$, 75% solution in water | 23.5 | 23.5 |
| $HNO_3$, 100% | 7.57 | 7.57 |
| $(HONH_2)_2.H_2SO_4$ | 0.03 | 0.03 |
| MnO | 0.38 | 0.38 |
| ZnO | 1.0 | 1.0 |
| $NaNO_3$ | 13.1 | 13.1 |
| Solution in water of $Ni(NO_3)_2$, the solution containing 14.0% of Ni | 6.41 | 6.41 |
| Hydrofluoric Acid 48% | 0.67 | 0.67 |
| $NH_4OH$ | 11.57 | 11.57 |

TABLE 3-continued

| | Concentration, as % of the Total Composition, for the Ingredient Shown at Left, in Concentrate for: | |
|---|---|---|
| Ingredient | Example 2 | Comparison Example 2 |
| Solution in water of $Co(NO_3)_2$, the solution containing 13.2% of Co | 0.74 | none |
| Additional water | Balance | Balance |

Working compositions were made by diluting each concentrate shown in Table 3 to a concentration of 7.4% by weight. During the dilution process, sufficient sodium carbonate was added to lower the Free Acid and Total Acid values to 2.7 points and 27.7 points, respectively. Conventional rectangular test panels of hot-dip galvanized steel were used, and the substrates were subjected to the following sequence of process operations, on all of which contact between the substrate and the treatment liquid was by immersion unless otherwise stated:

1. Clean for 10 seconds by a spray process using PARCO Cleaner 1200.
2. Rinse with tap water for 10 seconds.
3. Condition for 1 second by a spray process using PARCOLENE AT.
4. Form phosphate coating by immersion (in a reaction cell with counter current flow) for 10 seconds in one of the working phosphating compositions described last above, the phosphating composition being maintained at 71° C. during its contact with the substrate.

After being thus prepared, the panels were examined at 1000 times magnification by scanning electron microscopy. Based on this examination the average crystal sizes of the two coatings were measured. These data are summarized in Table 4.

TABLE 4

| Identification | Average Crystal size $\mu$m |
|---|---|
| Example #2 | 4.0 |
| Comparison Example #2 | 9.5 |

EXAMPLE AND COMPARISON EXAMPLE 3

In these tests, example and comparison example concentrates were first prepared, using the ingredients shown in Table 5 below. Examples 3*b*–3*e* are not considered to be within the scope of the present invention, as these formulations do not contain either Mn or Ni. However, these examples are being included herewith for purposes of illustrating the effect of Co concentration on crystal size, independent of any influence of Mn and/or Ni.

TABLE 5

| Ingredient | Concentration, as % of the Total Composition, for the Ingredient Shown at Left, in Concentrate for: | | | | |
|---|---|---|---|---|---|
| | Example 3a | Example 3b | Example 3c | Example 3d | Example 3e |
| $H_3PO_4$, 75% solution in water | 21.0 | 21.0 | 21.0 | 21.0 | 21.0 |
| ZnO | 6.6 | 6.6 | 6.6 | 6.6 | 6.6 |
| Hydrofluoric Acid 48% | 1.16 | 1.16 | 1.16 | 1.16 | 1.16 |
| Hydrofluorsilicic Acid 25% | 15.96 | 15.96 | 15.96 | 15.96 | 15.96 |
| Solution in water of $Co(NO_3)_2$, the solution containing 13.2% of Co | None | 0.145 | 0.726 | 1.453 | 7.264 |
| Additional Water | balance | balance | balance | balance | balance |

Working compositions were made by diluting each concentrate shown in Table 4 to a concentration of 5.3% by weight. During the dilution process, sufficient sodium carbonate was added to lower the Free Acid and Total Acid values to 2.8 points and 22.6 points respectively. Conventional rectangular test panels of hot-dip galvanized steel were used, and the substrates were subjected to the following sequence of process operations, on all of which contact between the substrate and the treatment liquid was by immersion unless otherwise stated:

1. Clean for 10 seconds by a spray process using PARCO Cleaner 1200.
2. Rinse with tap water for 10 seconds.
3. Condition for 1 second by a spray process using PARCOLENE AT.
4. Form phosphate coating by immersion (in a reaction cell with counter current flow) for 10 seconds in one of the working phosphating compositions described last above, the phosphating composition being maintained at 71° C. during its contact with the substrate.

After being thus prepared, the panels were examined at 1000 times magnification by scanning electron microscopy. Based on this examination the average crystal sizes of the two coatings were measured. These data are summarized in Table 6. These examples demonstrate that the average crystal size of the zinc phosphate coating is minimized under these conditions at between 10 and 100 ppm Co.

TABLE 6

| Identification | Average Crystal size $\mu$m |
|---|---|
| Example 3a | 12.5 |
| Example 3b | 6.5 |
| Example 3c | 1.5 |
| Example 3d | 3.0 |
| Example 3e | 7.5 |

What is claimed is:

1. A liquid composition of matter useful for forming a phosphate conversion coating on a metal substrate, said liquid composition comprising water and:

(A) 0.2 to 20 weight % (measured as $H_3PO_4$ stoichiometric equivalent) dissolved phosphate ions;

(B) 10 to 200 part per million dissolved cobalt cations;

(C) 0.020 to 2.0 weight % dissolved zinc cations;

(D) 0.010 to 0.60 weight % dissolved nickel cations; and (E) 0.010 to 0.60 weight % dissolved manganese cations;

wherein said dissolved cobalt cations and dissolved zinc cations are present in a weight ratio Co:Zn of not greater than 0.200:1.0 and said dissolved nickel cations, dissolved manganese cations and dissolved zinc cations are present in a weight ratio (Ni+Mn):Zn of not greater than 3.0:1.00.

2. The liquid composition of claim 1 wherein the weight ratio (Ni+Mn):Zn is not greater than 2.0:1.00.

3. The liquid composition of claim 1 additionally comprising at least one phosphating accelerator.

4. The liquid composition of claim 1 additionally comprising at least one nitrate.

5. The liquid composition of claim 4 additionally comprising hydroxylamine in free or bound form.

6. The liquid composition of claim 1 additionally comprising dissolved chelating molecules.

7. The liquid composition of claim 1 additionally comprising an acidity adjustment agent.

8. The liquid composition of claim 1 additionally comprising dissolved fluoride ions.

9. The liquid composition of claim 1 additionally comprising dissolved iron cations.

10. The liquid composition of claim 1 additionally comprising a sludge conditioner.

11. The liquid composition of claim 1 wherein dissolved nickel cations and dissolved manganese cations are present in concentrations such that the ratio of percent concentration of manganese cations to the percent concentration of nickel cations is from 0.10:1.00 to 1.8:1.00.

12. The liquid composition of claim 1 wherein dissolved phosphate anions, measured as the stoichiometric equivalent of orthophosphoric acid, and dissolved zinc cations are present at the znc;phosphate weight ratio of from 0.01:1.00 to 1.0:1.00.

13. The liquid composition of claim 1 wherein said dissolved cobalt ions, dissolved nickel cations and dissolved manganese cations are present in a weight ratio Co: of from 0.004:1.00 to 0.15:1.0.

14. The liquid composition of claim 1 additionally comprising a phosphating accelerator, dissolved chelating molecules, and an acidity adjustment agent.

15. The liquid composition of claim 1 which is substantially free of dissolved unchelated calcium and magnesium-cations.

16. The liquid composition of claim 1 which is substantially free of dissolved copper cations.

17. The liquid composition of claim 1 which is substantially free of dissolved chromium in any chemical form.

18. A method for producing a phosphate conversion containing on a zinciferous metal substrate surface, said method comprising contacting said zinciferous metal substrate surface with the liquid composition of claim 1 at a temperature of from 25° C. to 95° C. four a time of not greater than 45 seconds.

19. A liquid composition of matter useful for forming a phosphate conversion coating on a metal substrate, said liquid composition comprising water and:

(A) 0.75 to 1.4 weight % dissolved phosphate ions;

(B) 10 to 100 parts per million dissolved cobalt cations;

(C) 0.050 to 0.33 weight % dissolved zinc cations;

(D) 0.060 to 0.15 weight % dissolved nickel cations; and (E) 0.020 to 0.15 weight % dissolved manganese cations;

wherein said dissolved cobalt cations and dissolved zinc cations are present in a weight ratio Co:Zn of not greater than 0.150:1.0 and said dissolved nickel cations, dissolved manganese cations and dissolved zinc cations are present in a weight ratio (Ni+Mn):Zn of not greater than 2.1:1.00.

* * * * *

UNITED STATES PATENT AND TRADEMARK OFFICE

CERTIFICATE OF CORRECTION

PATENT NO. : 6,530,999 B2
DATED : March 11, 2003
INVENTOR(S) : Meagher et al.

It is certified that error appears in the above-identified patent and that said Letters Patent is hereby corrected as shown below:

Column 14,
Line 44, delete “znc;” and insert therefor -- zinc: --.
Line 54, after “magnesium”, delete “-”.
Line 63, delete “four” and insert therefor -- for --.

Signed and Sealed this

Third Day of February, 2004

JON W. DUDAS
*Acting Director of the United States Patent and Trademark Office*